US005980821A

United States Patent [19]

Brill

[11] Patent Number: 5,980,821

[45] Date of Patent: Nov. 9, 1999

[54] AUSTENITIC NICKEL-CHROMIUM-IRON ALLOY

[75] Inventor: Ulrich Brill, Dinslaken, Germany

[73] Assignee: Krupp-VDM GmbH, Germany

[21] Appl. No.: 07/862,486

[22] Filed: Apr. 2, 1992

[30] Foreign Application Priority Data

Apr. 11, 1991 [DE] Germany ..... 41 11 821

[51] Int. Cl.[6] ..... C22C 19/05

[52] U.S. Cl. ..... 420/443; 420/448; 420/584.1

[58] Field of Search ..... 420/443, 447, 420/448, 584.1; 148/410, 428, 442

[56] References Cited

U.S. PATENT DOCUMENTS 4,784,830 11/1988 Ganesan et al. ..... 148/428
5,217,684 6/1993 Igarashi et al. ..... 420/448

FOREIGN PATENT DOCUMENTS 61-079742 4/1986 Japan .

*Primary Examiner*—Scott Kastler
*Attorney, Agent, or Firm*—Proskauer Rose LLP

[57] ABSTRACT

The invention relates to an austenitic-chromium-iron alloy and its use as a material for articles with high resistance to isothermal and cyclic high temperature oxidation, high heat-resistance and high creep rupture strength at temperatures above 1100 to 1200° C. The characterizing feature of the invention is that the austenitic nickel-chromium-iron alloy consists (in % by weight) of:

| | |
|---|---|
| 0.12 to 0.30% | carbon |
| 23 to 30% | chromium |
| 8 to 11% | iron |
| 1.8 to 2.4% | aluminium |
| 0.01 to 0.15% | yttrium |
| 0.01 to 1.0% | titanium |
| 0.01 to 1.0% | niobium |
| 0.01 to 0.20% | zirconium |
| 0.001 to 0.015% | magnesium |
| 0.001 to 0.010% | calcium |
| max 0.030% | nitrogen |
| max 0.50% | silicon |
| max 0.25% | manganese |
| max 0.020% | phosphorus |
| max 0.010% | sulphur |

residue nickel, including unavoidable impurities caused by melting.

4 Claims, 3 Drawing Sheets

AUSTENITIC NICKEL-CHROMIUM-IRON ALLOY

FIELD OF THE INVENTION

The invention relates to an austenitic nickel-chromium-iron alloy and its use as a material for articles having high resistance to isothermal and cyclic high temperature oxidation, high resistance to heat and high creep rupture strength at temperatures above 1100 to 1200° C.

Articles such as furnace components, radiation tubes, furnace rollers, furnace muffles and supporting systems in kilns for ceramic products are not only loaded isothermally in operation at very high temperatures above 1000° C., but they must also withstand temperature loadings during the heating and cooling of the furnaces or radiation tubes.

They must therefore have outstanding scale resistance, not only with isothermal, but also with cyclic oxidation, and also have adequate resistance to heat and creep rupture strength.

DESCRIPTION OF THE PRIOR ART

U.S. Pat. No. 3,607,243 disclosed for the first time an austenitic alloy having contents of (details in % by weight) up to 0.1% carbon, 58–63% nickel, 21–25% chromium, 1–1.7% aluminium, and also optionally up to 0.5% silicon, up to 1.0% manganese, up to 0.6% titanium, up to 0.006% boron, up to 0.1% magnesium, up to 0.05% calcium, residue iron, the phosphorus content being below 0.030% and the sulphur content below 0.015%; this alloy has particularly high resistivity, more particularly to cyclic oxidation at temperatures up to 2000° F. (1093° C.). The heat resistance values are stated as follows: 80 MPa for 1800° F., 45 MPa for 2000° F. and 23 MPa for 2100° F.

After 1000 hours the creep rupture strength was 32 MPa for 1600° F., 16 MPa for 1800° F. and 7 MPa for 2000° F. Material NiCr23Fe (Material No. 2.4851 and UNS Designation N 06601), which lies within these alloying limits, was introduced for industrial use on that basis. The material proves its usefulness above all when applied in the temperature range above 1000° C. This is due to the formation of a protective layer of chromium oxide-aluminium oxide, but more particularly to the overall low tendency of the oxide layer to peel off under alternating temperature loadings. The material has therefore been developed into an important material in industrial furnace construction. Typical applications are radiation tubes for gas-heated furnaces and conveying rollers in roller hearth furnaces for ceramic products. Moreover, the material is also suitable for parts of waste gas detoxification installations and petrochemical plants. To further enhance the properties decisive for the use of this material for utilization temperatures above 1100 to 1200° C., according to U.S. Pat. No. 4,784,830 nitrogen in quantities of 0.04 to 0.1% by weight are added to the material known from U.S. Pat. No. 3,607,243, while at the same time a titanium content of 0.2 to 1.0% is compulsory. Advantageously the silicon content should also be above 0.25% by weight and so correlated with the titanium content as to obtain a Si:Ti ratio of 0.85 to 3.0. The chromium contents are 19–28%, the aluminium contents being 0.75–2.0%, with nickel contents of 55–65%.

By these steps an improvement in resistance to oxidation with utilization temperatures up to 1200° C. is achieved, something which enabled the service life of, for example, furnace rollers to be increased to 12 months and more, in comparison with 2 months in the case of furnace rollers made from the material disclosed in U.S. Pat. No. 3,607,243.

This improvement in the service life of furnace components is mainly due to a stabilization of the microstructure by titanium nitrides at temperatures of 1200° C. As described in U.S. Pat. No. 3,607,243, the carbon content also must not exceed 0.1% by weight, to prevent the formation of carbides, more particularly of the type $M_{23}C_6$, since these have a disadvantageous effect on microstructure and on the properties of the alloy at very high temperatures.

However, not only resistance to oxidation (expressed by cyclic change in weight ($g/m^2.h$) in air at high test temperatures, e.g., 2000° F., as described in U.S. Pat. No. 4,784,830) is decisive for the service life of highly heat-resistant particles, but so are resistance to heat and creep rupture strength at the particular temperatures of utilization.

SUMMARY OF THE INVENTION

It is an object of the invention so to design nickel-chromium-iron alloys of the kind specified that, accompanied by adequate resistance to oxidation, the values of heat resistance and creep rupture strength are improved, thus significantly increasing the service life of articles made from such alloys.

This problem is solved by an austenitic nickel-chromium-iron alloy, consisting of (details in % by weight):

| | |
|---|---|
| carbon | 0.12 to 0.30% |
| chromium | 23 to 30% |
| iron | 8 to 11% |
| aluminium | 1.8 to 2.4% |
| yttrium | 0.01 to 0.15% |
| titanium | 0.01 to 1.0% |
| niobium | 0.01 to 1.0% |
| zirconium | 0.01 to 0.20% |
| magnesium | 0.001 to 0.015% |
| calcium | 0.001 to 0.010% |
| nitrogen | max 0.030% |
| silicon | max 0.50% |
| manganese | max 0.25% |
| phosphorus | max 0.020% |
| sulphur | max 0.010% |
| nickel | residue |

including unavoidable impurities caused by melting.

DESCRIPTION OF THE PREFERRED EMBODIMENT(S)

In a preferred variant of the alloy, the contents are as follows:

| | |
|---|---|
| carbon | 0.15 to 0.25% |
| chromium | 24 to 26% |
| aluminium | 2.1 to 2.4% |
| yttrium | 0.05 to 0.12% |
| titanium | 0.40 to 0.60% |
| niobium | 0.40 to 0.60% |
| zirconium | 0.01 to 0.10% |
| nitrogen | max 0.010%. |

with unaltered ranges of content of the rest of the alloying elements.

The nickel-chromium-iron alloy according to the invention has carbon contents of 0.12 to 0.3% by weight, in contrast with the prior art, which permits carbon contents only up to 0.10% by weight at the most, since it was believed that only such low carbon contents could ensure the required existence to oxidation at temperatures up to 1200° C.

Surprisingly, carbon contents of this order of magnitude in conjunction with the other additives provided according to the invention, more particularly yttrium and zirconium, not only enhance heat resistance and creep rupture strength, but also improve resistance to oxidation.

Since in the alloy according to the invention the nitrogen content is kept as low as possible, the carbon contents according to the invention of 0.12 to 0.30% by weight, in conjunction with the stable carbide formers titanium, niobium and zirconium, produce essentially carbides of said elements which are thermally stable even at temperatures up to 1200° C. As a result, the formation of chromium carbides of the type $Cr_{23}C_6$ is substantially prevented thereby. The result is that in the first place, the formation of the titanium, niobium and zirconium carbides, which have greater thermal stability than the chromium carbides, lastingly improves resistance to heat and creep rupture strength, while in the second place more chromium is available for the formation of a protective chromium oxide layer, so that resistance to oxidation is improved with the simultaneous addition of yttrium and zirconium.

Chromium contents of at least 23% by weight are required to ensure adequate resistance to oxidation at temperatures of above 1100° C. The top limit should not exceed 30% by weight, to avoid problems in the hot working of the alloy.

Particularly in the temperature range between 600 and 800° C., which the material when used passes through both during heating and also cooling, aluminium improves resistance to heat by the precipitation of the phase $Ni_3Al$ (so-called γ' phase). Since the precipitation of this phase is at the same time connected with a drop in toughness, the aluminium contents must be limited to 1.8 to 2.4% by weight.

The silicon content should be as low as possible, to avoid the formation of low-melting phases. The manganese content should not exceed 0.25% by weight, to avoid negative effects on the resistance to oxidation of the material.

Additions of magnesium and calcium improve hot workability and also enhance resistance to oxidation. However, the top limits of 0.015% by weight (magnesium) and 0.010% by weight (calcium) should not be exceeded, since magnesium and calcium contents. above these limit values encourage the occurrence of low-melting phases and therefore lead to a deterioration in hot workability.

The iron contents of the alloy according to the invention lie in the range of 8 to 11% by weight, these values being determined by the need to be able to use cheap ferrochrome and ferronickel in the melting of the alloy.

The advantages achieved by the alloy according to the invention will be explained in detail hereinafter. Table 1 takes the analyses of two alloys A and B according to the invention and a prior art alloy C, such as can be gathered from U.S. Pat. No. 4,784,830.

TABLE 1

| | Alloy A | Alloy B | Alloy C |
|---|---|---|---|
| | (contents stated in % by weight) | | |
| carbon | 0.18 | 0.18 | 0.055 |
| chromium | 25.0 | 25.5 | 23.0 |
| iron | 11.0 | 10.0 | 14.0 |
| aluminium | 1.85 | 2.10 | 1.35 |
| yttrium | 0.06 | 0.11 | |
| titanium | 0.15 | 0.59 | 0.45 |
| niobium | 0.01 | 0.59 | |
| zirconium | 0.10 | 0.10 | |
| magnesium | 0.008 | 0.006 | |
| calcium | 0.002 | 0.001 | |
| nitrogen | 0.002 | 0.006 | 0.040 |
| silicon | 0.29 | 0.06 | 0.40 |

TABLE 1-continued

| | Alloy A | Alloy B | Alloy C |
|---|---|---|---|
| | (contents stated in % by weight) | | |
| manganese | 0.15 | 0.02 | 0.25 |
| phosphorus | 0.004 | 0.003 | 0.011 |
| sulphur | 0.003 | 0.002 | 0.004 |
| nickel | residue | residue | residue |

BRIEF DESCRIPTION OF THE DRAWINGS

The material properties of these alloys form the subject matter of FIGS. 1 to 5, which show.

Figure 1:
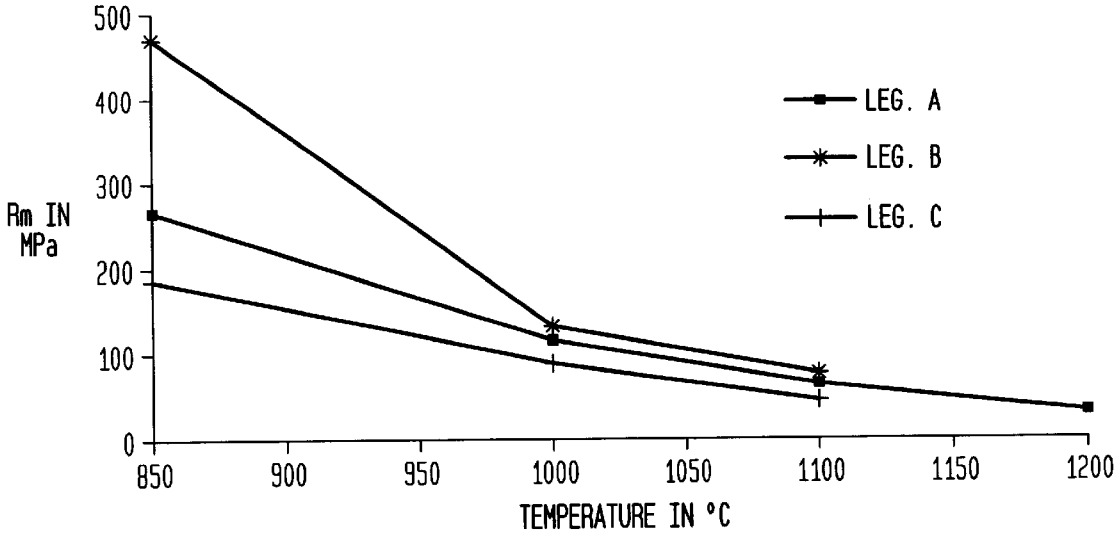
FIG. 1 for the alloys A, B and C heat resistance Rm (MPa) in dependence on temperature (° C.)
Figure 2:
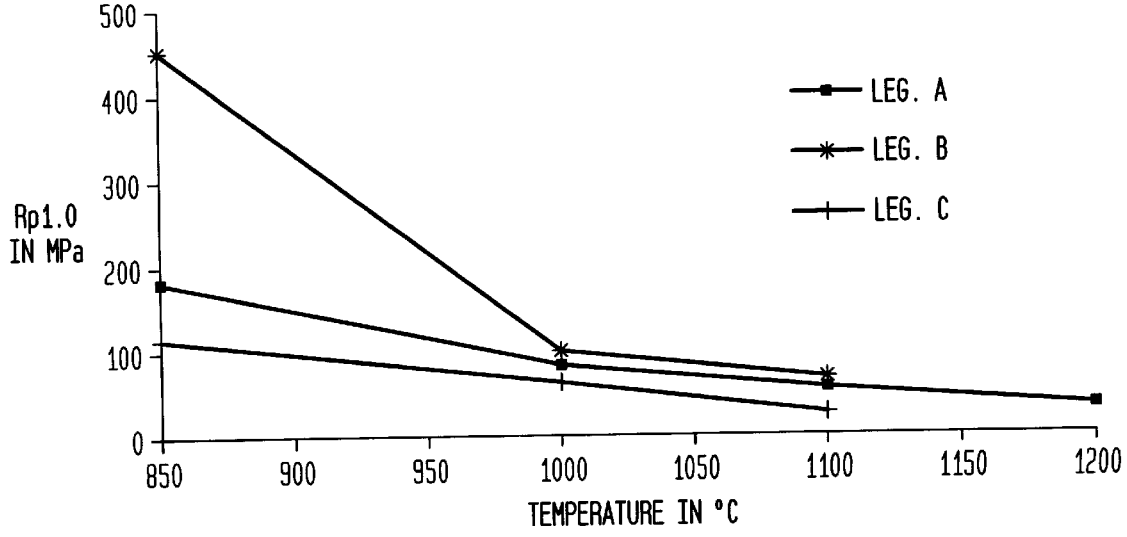
FIG. 2 for the alloys A, B and C the 1% yield point Rp (MPa) in dependence on temperature (° C.)

The values plotted in dependence on temperature in FIG. 1 for heat resistance and in FIG. 2 for the 1% yield point are important characteristic values, indicating the extent to which the material can be loaded at a particular temperature.

It must be noted that over the whole temperature range in question of 850 to 1200° C., the alloy according to the invention has distinctly higher values than the prior art alloy C as regards both heat resistance Rm and also the 1% yield point Rp.

Even better values are achieved by the alloy B according to the invention, whose composition lies within the variant alloy set forth in claim 2. By this variant alloy both the heat resistance and also the yield point can be almost doubled up to temperatures of 1000° C.

Figure 3:
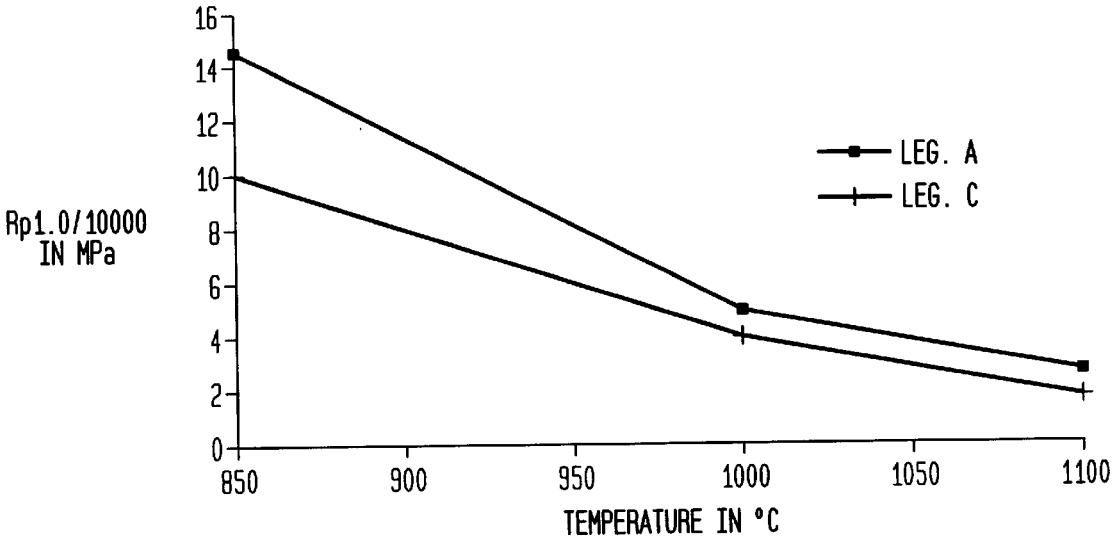
FIG. 3 for the alloys A and C the 1% time yield limit Rp 1.0/10000 (MPa) after a time of 10000 hours in dependence on temperature (° C.)
Figure 4:
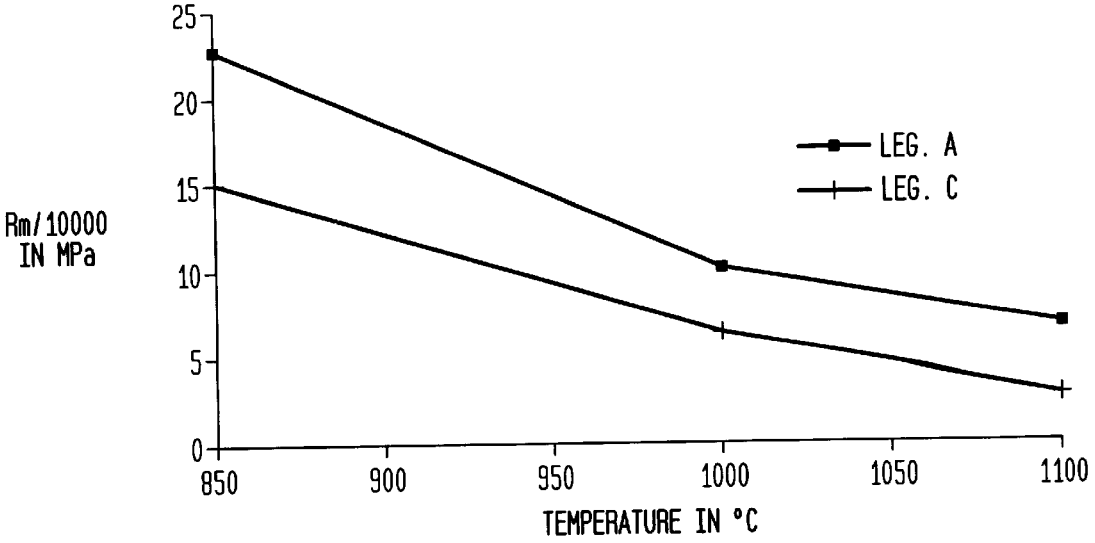
FIG. 4 for the alloys A and C the creep rupture strength in dependence on temperature Rm/10000 (MPa) after a time of 10000 hours in dependence on temperature (°), and FIG. 5 for the alloys A and C the cyclic resistance to oxidation in air (specific change in weight in $g/m^2.h$) in dependence on temperature (° C.).

FIG. 3 and FIG. 4 compare the creep rupture strength behavior of the alloy A according to the invention with that of the prior art alloy C.

The creep rupture strength and the 1% time yield point were determined in the usual creep tests (cf. "Werkstoffkunde Stahl", Vol. 1, published by Springer Verlag, Berlin, 1984, pages 384 to 396 and DIN 50118).

Creep rupture strength (MPa) is taken to be a measurement of the capability of the material not to be destroyed by the effect of an operative load. The 1% time yield point, which states the stress (in MPa) for a given loading time at which a 1% expansion is reached, characterizes the functional failure of material at a particular long-term loading for the temperature in question.

The alloy A according to the invention is clearly superior to the prior art alloy C over the whole temperature range both as regards creep rupture strength and also the 1% time yield point. In comparison with the alloy C, the gain in strength of the alloy A according to the invention is more than 25% at every temperature.

Figure 5:
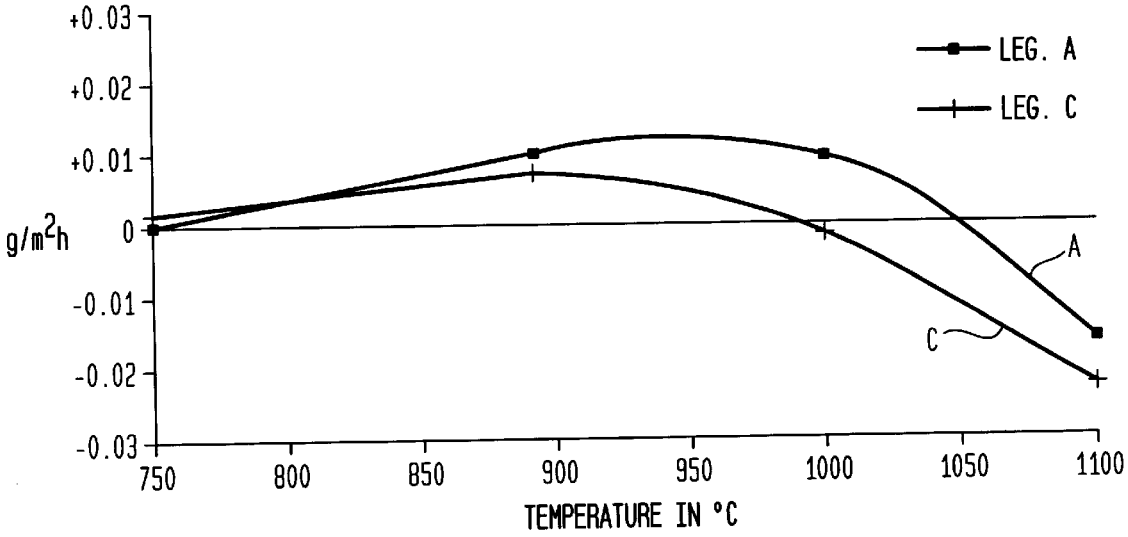

In FIG. 5 the cyclic resistance to oxidation determined in air for the alloys A and C are compared by plotting specific change in weight over temperature. As a rule increases in weight (+) are desirable, since reductions in weight (−) are often an indication of heavily peeling scale.

For this reason the behavior of the alloy A according to the invention must be considered superior to that of the prior art alloy C, which intersects the abscissa (transition to loss in weight) as early as about 1000° C., while the alloy A passes through zero only at approximately 1050° C.

Due to its satisfactory properties at elevated temperatures, the nickel-chromium-iron alloy according to the invention is a preferred material for articles which must have a creep rupture strength (Rm/10000) of at least 5 MPa, accompanied by a 1% time yield point (Rp 1.0/10000) of at least 2 MPa and high resistance to oxidation in practical operation, referred to a temperature of 1100° C. and a loading duration of 10000 hours, such as, for example:

- radiation tubes for the heating of furnaces
- furnace rollers for the annealing of metal or ceramic goods
- muffles for scaling furnaces, for example, for furnaces for the bright annealing of special quality steels
- tubes for oxygen heating in the production of titanium dioxide ($TiO_2$)
- ethylene cracking tubes
- furnace frames and supporting crosses for steady annealings
- installations for exhaust manifolds
- catalyst foils for waste gas purification, more particularly in the case of thermally heavily loaded small petrol engines, such as engines for chain saws, hedge clippers and lawn mowers.

The aforementioned articles can readily be produced from the material according to the invention, since it can not only be satisfactorily hot worked, but also has the necessary shaping capacity for cold working processes such as, for instance, cold rolling to thin dimensions, chamfering, deep drawing, flanging.

(Captions of drawings):

FIG. 1=heat resistance Rm, details in MPa; Leg.=alloy;

FIG. 2=1% yield point Rp, details in Mpa;

FIG. 3=1% time yield point Rp 1.0/10000, details in MPa;

FIG. 4=creep rupture strength Rm/10000, details in MPa;

FIG. 5=cyclic resistance to oxidation in air, details in $g/m^2.h$; (top left) specific change in weight in $g/m^2.h$

I claim:

1. An austenitic nickel-chromium-iron alloy consisting of (details in % by weight):

| | |
|---|---|
| carbon | 0.12 to 0.30% |
| chromium | 23 to 30% |
| iron | 8 to 11% |
| aluminium | 1.8 to 2.4% |
| yttrium | 0.01 to 0.15% |
| titanium | 0.01 to 1.0% |
| niobium | 0.01 to 1.0% |
| zirconium | 0.01 to 0.20% |
| magnesium | 0.001 to 0.015% |
| calcium | 0.001 to 0.010% |
| nitrogen | max 0.030% |
| silicon | max 0.50% |
| manganese | max 0.25% |
| phosphorus | max 0.020% |
| sulphur | max 0.010% |
| nickel | residue |

including unavoidable impurities.

2. An austenitic nickel-chromium-iron alloy according to claim 1, having the following contents:

| | |
|---|---|
| carbon | 0.15 to 0.25% |
| chromium | 24 to 26% |
| aluminium | 2.1 to 2.4% |
| yttrium | 0.05 to 0.12% |
| titanium | 0.40 to 0.60% |
| niobium | 0.40 to 0.60% |
| zirconium | 0.01 to 0.10% |
| nitrogen | max 0.010%. |

3. An article which has a creep rupture strength (Rm/10,000) of at least 5 MPa with a 1% time yield limit (Rp 1.0/10,000) of at least 2 MPa and a high resistance to oxidation under a thermal load of 1100° C. for 10,000 hours, said article being made from an austenitic nickel-chromium-iron alloy according to claim 1.

4. An article which has a creep rupture strength (Rm/10,000) of at least 5 MPa with a 1% time yield limit (Rp 1.0/10,000) of at least 2 MPa and a high resistance to oxidation under a thermal load of 1100° C. for 10,000 hours, said article being made from an austenitic nickel-chromium-iron alloy according to claim 2.

* * * * *